United States Patent [19]

Leuthesser

[11] 4,277,904

[45] Jul. 14, 1981

[54] BACK LIGHTED SIGN FRAME

[75] Inventor: Fred W. Leuthesser, Knoxville, Tenn.

[73] Assignee: Benco Industries, Inc., Knoxville, Tenn.

[21] Appl. No.: 93,991

[22] Filed: Nov. 14, 1979

[51] Int. Cl.[3] ..... G09F 13/4

[52] U.S. Cl. ..... 40/564; 40/152.2; 40/155

[58] Field of Search ..... 40/152.1, 152.2, 155, 40/152, 584, 564

[56] References Cited

U.S. PATENT DOCUMENTS

| | | | |
|---|---|---|---|
| D. 245,289 | 8/1977 | Niehaus et al. | 40/564 X |
| D. 246,400 | 11/1977 | Niehaus et al. | 40/564 X |
| 579,243 | 3/1897 | Schulze | 40/155 |
| 1,202,321 | 10/1916 | Schleicher | 40/155 |
| 2,218,828 | 10/1916 | Page | 40/152 |
| 2,858,629 | 11/1958 | Carter | 40/152.2 X |
| 2,902,787 | 9/1959 | Cook | 40/152.2 |
| 4,021,949 | 5/1977 | Niehaus et al. | 40/564 X |
| 4,034,946 | 7/1977 | Cohen | 40/152 |

FOREIGN PATENT DOCUMENTS

| | | | |
|---|---|---|---|
| 630045 | 5/1936 | Fed. Rep. of Germany | 40/152.2 |

*Primary Examiner*—Robert Peshock
*Assistant Examiner*—Wenceslao J. Contreras

[57] ABSTRACT

A sign comprises a frame having a rectangular front wall and side walls peripherally joined to the front wall. The side walls extend rearwardly from the front wall to define a rearwardly opening cavity. An aperture is defined in the front wall and includes an interior peripheral edge. Ledge means are joined to the front wall around the interior peripheral edge, extending rearwardly and inwardly therefrom. Display panel means, having a shape congruent with the aperture and sized for reception within the aperture, are supported by the ledge means. The frame comprises a pair of side members, each including an elongated central section and a first end section and second end section extending perpendicularly from the central section. Means are provided for linearly attaching each first end section to the second end section of the other side member.

5 Claims, 6 Drawing Figures

BACK LIGHTED SIGN FRAME

The present invention relates to signs and more particularly to an improved frame for back lighted signs.

Back lighted signs are frequently used for advertising and promotion. Generally, in a back lighted sign, an opaque message and/or picture is applied to a transluscent panel. The panel is mounted upon a front wall of a frame including side walls which are peripherally joined to the front wall and extend rearwardly therefrom to define a rearwardly opening cavity. An aperture is defined in the front wall behind the sign panel so that a light mounted within the cavity shines through the aperture and panel to accentuate the messages and/or picture during the day and/or display the sign at night. Inasmuch as such signs normally are wall mounted, hence having substantial thickness and exposed sides behind the display panel, it becomes important to design the sign to provide maximum aesthetics when viewed from an angle other than straight on. Heretofore, it has been common to provide opaque sides for such signs, but such design produces a harshness in appearance that is undesirable, i.e., an abrupt change in lighting effect between the front of the sign and the sides.

Frequently, it is desirable for several individual, but related, signs to be mounted in side-by-side relation. For example, a picture of a vended article, alone or in use, may be displayed on one panel while a description and/or price of the article may be removably mounted upon an adjacent second panel. In some cases a clock face is used in place of a sign panel and a clock mechanism is mounted within the cavity with the clock hands exposed on the exterior of the clock face. The side-by-side signs also economize by using a single power supply cord and a single electrical outlet.

Many back lighted sign frames are manufactured by injection moulding transluscent plastic material such as high impact polystyrene. However, it is difficult to properly mold a single large frame having a multiplicity of separate apertures, one for each of the sign panels in the frame. If there is a flaw in any portion of the frame, the entire molded frame must be scrapped. Also, it is expensive to provide separate molds for single signs, double signs, triple signs, etc. Nor is it cost efficient from a materials standpoint to merely attach two or more individual signs side-by-side because such attachment requires unnecessary internal side walls or partitions. Such internal partitions usually are twice the thickness of the exterior side walls so that they are not only wasteful of material, but they also block or diffuse light to create grotesque appearances when viewed from other than the front side of the sign.

In accordance with the present disclosure, there is provided a modular frame structure for a back lighted sign wherein there may be constructed a single sign or a plurality of side-by-side signs, employing a minimum number of different components, all of which may be molded using a minimum number of molds. Specifically, the basic frame comprises a set of end members that are essentially identical, hence can be molded from a single mold, but each of which can be used on either end of a frame, and at least two connecting side members that also are suitable for use on either side of the frame, but which are moldable employing the same mold as with the end members.

Further, in the present sign, there is provided a back housing for the modular frame and which includes translucent sides that are joined along their perimetral edges to the frame structure in a manner which produces a relatively smooth transition at such joinder so that the observer's eye is not distracted from the display panel by an obtrusive, relatively unlighted and dark ring around the perimeter of the signs. Such transition is accomplished by forming the frame structure in a generally truncated open pyramid geometry, i.e., a rectangular "ring" having an outwardly flared opening that fits over relatively thin perimetral edges of the back housing side panels with minimal contact therebetween, e.g., essentially line contact, and minimal connections therebetween that might attenuate light transmittance therethrough. Further, the perimetral edge portion of the flared opening of the frame extends beyond the perimetral edges of the back housing side panels to further diffuse the light transmission effect of the joinder.

It is therefore an object of the present invention to provide a back lighted sign frame which is of modular construction and which is assembled from a few simple frame members which are easily molded using an injection molding system. It is also an object to provide simple frame members which are assembled into single or multiple back-lighted sign frames as desired. It is another object to provide a back lighted sign having improved side illumination.

Other objects and advantages will become apparent by reference to the following description and accompanying drawings in which.

Figure 2:
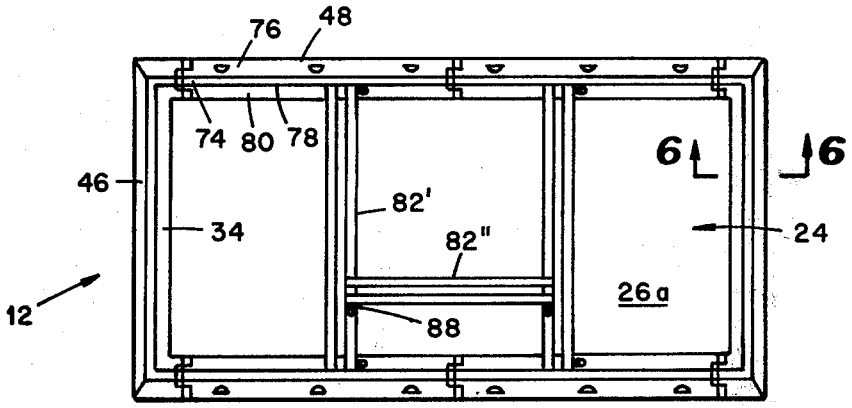
FIG. 2 is an elevational rear view of the frame of the sign shown in FIG. 1.
Figure 6:
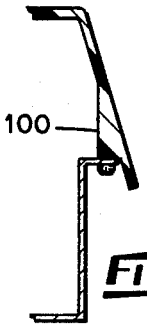
Figure 5:
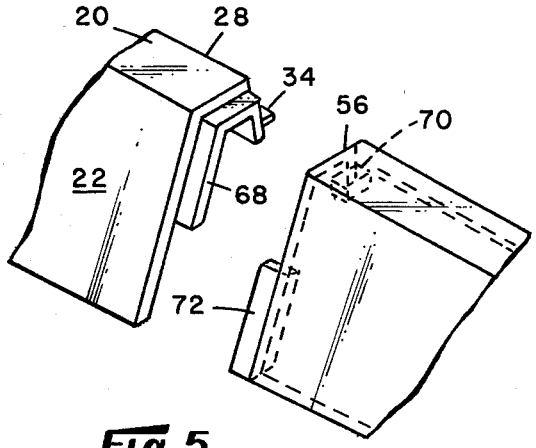
FIG. 5 is a fragmentary view of a portion of the frame shown in FIG. 2.

FIG. 6 is a cross sectional view taken along line 6—6 of FIG. 2. As depicted in the accompanying Figures, in accordance with the present invention, there is provided a frame for a back lighted sign having a rectangular front wall and side walls peripherally joined to the front wall to define a rearwardly opening concavity. An aperture is defined in the front wall by an inner peripheral edge. Ledge means are attached to the front wall around the interior peripheral edge. A translucent panel having a shape congruent with the aperture is supported within the cavity by the ledge. Lighting means are mounted within the cavity.

In the depicted embodiment, the frame comprises a pair of side members, each of which includes an elongated central section, and integral first and second end sections, the end sections extending perpendicularly from respective opposite ends of the central section, codirectionally and parallel to one another. The frame further comprises at least one pair of elongated connector members. In assembling the frame, one of the connector members is colinearly attached at one of its ends to the first end section of one of a pair of spaced apart side members. The other end of the connector member is colinearly attached to the second end section of the other of the pair of side members. The second connector member is similarly colinearly attached at its opposite ends to the second end section of the first side member and to the first end section of the second side member to complete the rectangular frame.

Referring to the drawings, there is depicted a back lighted sign 10 including a frame 12, one or more display panels 14, and lighting means 16. Clock means 18 are provided in conjunction with one of the display panels 14. In the depicted embodiment, the frame 12 is rectangular, including a planar front wall 20 and planar side walls 22*a, b, c,* and *d* peripherally joined thereto to define a rearwardly opening cavity 24. A rectangular aperture 26 is defined in the front wall 20 by an interior peripheral edge 28. Ledge means 30 are joined to the front wall 20 around the interior peripheral edge 28 extending into the cavity 24. The ledge means 30 includes a rearwardly directed portion 32, perpendicular to the front wall 20, and an inwardly directed portion 34 extending from the portion 30, parallel to the front wall 20. The ledge means 30 are adapted to support a display panel 14 having a shape congruent with the aperture 26 and suitably sized for reception within the aperture 26. A transparent cover panel 36 is also supported by the ledge means 30. The cover panel 36, which overlays the entire display panel 14, includes tab means 38 along its peripheral edge 40. The tabs 38 are adapted for insertion into notches 42 defined in the rearwardly directed portion 32 of the ledge means 30. Thus, the display panel 14 is secured along its peripheral edge 44 between the portion 34 of the ledge means 30 and the cover panel 36.

The frame 12 in the depicited embodiment is modularly constructed from a plurality of polystyrene injection-molded members, including a pair of identical side frame members 46 and a pair of identical connector frame members 48. Each of the side members 46 includes an elongated central section 50, a first end section 52 extending perpendicularly from one end 54 of the central section 50 to a distal end 56 and a second end section 58 extending perpendicularly from the other end 60 of the central section 50 to a distal end 62. The first and second end sections 52 and 58, respectively, of each side frame member 46 are codirectional, parallel to one another and perpendicular to the central section 50. Thus, the side frame members 46 are generally C-shaped.

The connector frame members 48 are linear, each having a first end 64 and a second end 66. The pair of C-shaped side members 46 and an interconnecting pair of connector members 48 cooperatively define the rectangular frame 12, as noted above.

The side walls 22*a, b, c,* and *d* extend rearwardly and outwardly from the front wall 20. Each of the side walls 22*a* and 22*c* forms an angle of about 70° with the front wall 20. Each of the side walls 22*b* and 22*d* forms an angle of about 85° with the front wall 20.

The connector members 48 are attached to the side member end sections 52 and 58 by mating tabs 68, 70 and 72. The first end 64 of each of the connector members 48 carries a longitudinally extending tab 68. The tab 68 extends interiorly of the front wall 20, the forward portion of the side wall 22 and the rearwardly directed portion 32 of the ledge 30. The tab 68 is thus generally J-shaped in cross-section. The second end 66 of each of the connector members 48 carries two longitudinally extending tabs 70 and 72. The tab 70 extends interiorly of the inwardly directed portion 34 of the ledge 30. The tab 72 extends interiorly of the rearward portion of the side wall 22. The end 62 of the second end section 58 of each side member 46 carries a longitudinally extending tab 68, identical to the tab 68 on the first end 64 of the second member 48. The end 56 of the first end section 52 of each side member 46 carries two longitudinally extending tabs 70 and 72 identical to the tabs 70 and 72 on the second end 66 of the connector member 48.

The tabs 70 and 72 are adapted for mating engagement with a tab 68 when a first end 64 of a connector member 48 is longitudinally abutted with a first end section 52 of a side member 46 and when a second end 66 of a connector member 48 is longitudinally abutted with a second end section 58 of a side member 46. For example, when the first end 64 of a connector member 48 is longitudinally abutted with a first end section 52 of a side member 46, the tab 68 underlays and frictionally engages the interior surface 74 of the front wall 20, the forward portion of the interior surface 76 of the side wall 22 and the interior surface 78 of the rearwardly directed portion of the ledge 30 of the first end section 52 of the side member 46. The mating tab 70 on the first end section 52 of the side member 46 underlays and frictionally engages the rearward portion of the interior surface 76 of the side wall 22 of the first end 64 of the connector member 48. The mating tab 72 of the first end section 52 underlays and frictionally engages the interior surface 80 of the inwardly directed portion 34 of the ledge 30 of the connectormember 48.

The tabs 68, 70 and 72 are each about three-sixteenths inch in length, which provides ample surface area for the application of glue or other suitable adhesive when side members 46 and connector members 48 are permanently joined in longitudinally abutting relation in the construction of a frame 12.

Figure 1:
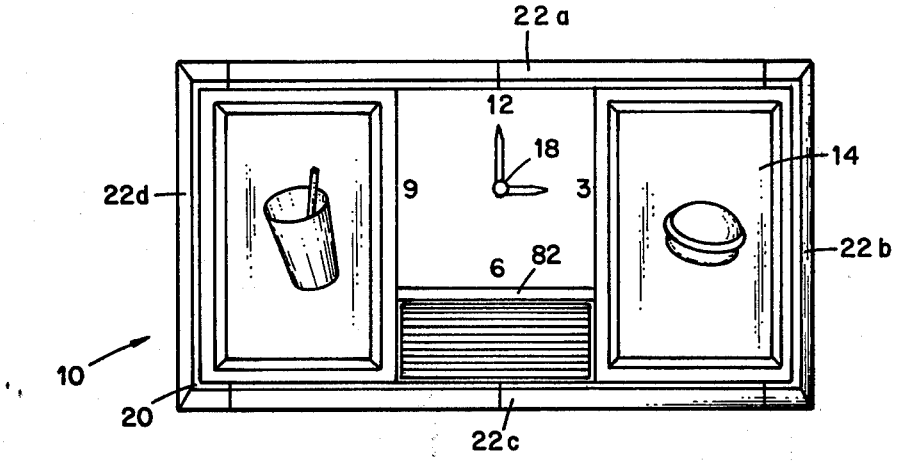
FIG. 1 is an elevational view of a three panel sign embodying various of the features of the present invention.

The alternating pattern of the tabs 68, 70 and 72 on the side members 46 and connector members 48, i.e. each member 46 and 48 carries a complete set of tabs 68, 70 and 72, permits identical side members 46 to be used for both sides of a sign frame 12. Similarly, identical connector members 48 are usable for both the top and bottom of a frame 12. Also, as shown in FIGS. 1 and 2, a plurality of connector members 48 are connectable longitudinally to extend the length of a frame 12 to any desired length to receive any number of display panels 14.

A side member 46 and a pair of connector members 48 are molded within a single mold which is generally C-shaped. A mold insert having the shape of a shortened connector member 48 is inserted into each leg of the mold to separate the side member 46 from the connector member 48 molded in each leg of the mold. In the alternative, a single side member 46, having elongated end sections 52 and 58 is molded alone. Such an elongated side member 46 may be attached to a pair of connector members 48 or even to another side member because of the alternating mating tabs 68, 70 and 72.

Figure 3:
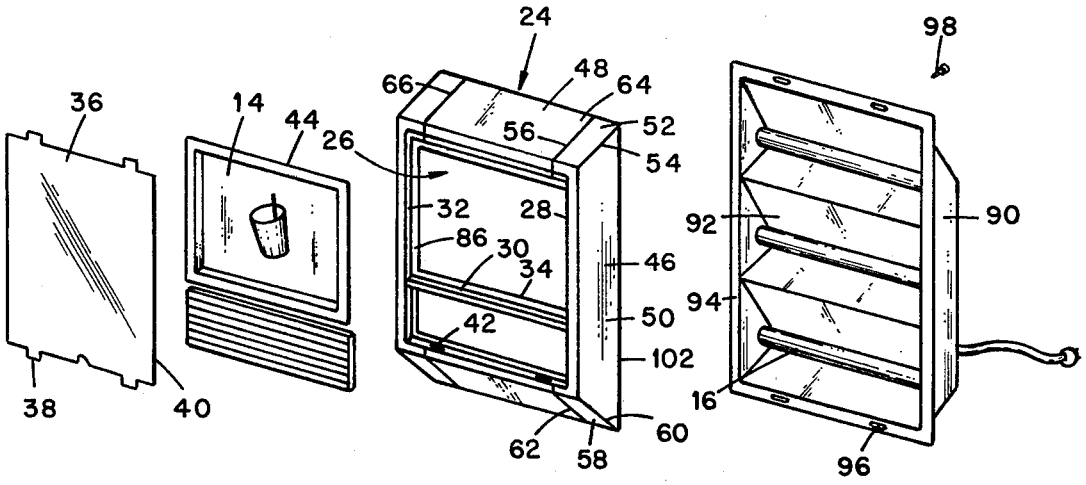
FIG. 3 is an exploded view of a sign embodying various of the features of the present invention.
Figure 4:
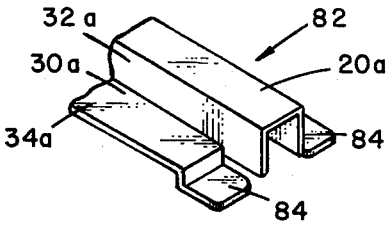
FIG. 4 is a fragmentary exploded view of a portion of a partition member.

It is desirable for each display panel 14 in a frame 12 to be supported around its entire peripheral edge 44 to prevent sagging into the cavity 24. Therefore, when it is desired to mount more than one display panel 14 within a single sign frame 12, elongated partition members 82 are attached within the aperture 26 defined in the front wall 20 to subdivide the aperture 26 into a plurality of subapertures 26*a*, each of which has a peripheral ledge 30. As shown particuarly in FIG. 3, wherein an aperture 26 is subdivided into two subapertures 26 *a*, an elongated partition member 82 extends between the opposed side members 46 of the frame 12.

The member 82 includes a planar front wall 20*a* and a pair of ledges 30*a* which extend away from one another. The member 82 is generally T-shaped in cross-section. Each ledge 30*a* includes rearwardly directed portion 32*a*, perpendicular to the front wall 20*a* and an inwardly directed portion 34*a*, parallel to the front wall 20*a*. The front wall 20*a* and the ledges 30*a* are essentially identical in both size and shape to the front wall 20 and the ledge 30 defined by the frame members 46 and 48.

The lengths of the front wall 20*a* and rearwardly directed portions 32*a* of the ledges 30*a* are equal to the width of the aperture 26, forming continuous surfaces thereof. The lengths of the inwardly directed portions 34*a* of the ledges 30*a* are less than the width of the aperture 26, reduced by the widths of the inwardly directed portions 34 of the first members 46, also forming a continuous surface. Extending between the side members 46 of the frame 12 the member 82 provides the subapertures 26*a* with a continuous front wall and ledge.

The partition member 82 is secured to the frame 12 by means of tabs 84. One tab 84 extends longitudinally from each end of the inwardly directed portion 34*a* of each ledge 30*a* of the member 82, i.e. there are four tabs 84 on each member 82. The tabs 84 underlay and frictionally engage the interior surface 80 of the inwardly directed portion 34 of the side members 46 between which the member 82 extends. The inwardly directed portion 34 of the side member 46 is thus engaged on the interior surface 80 by the tab 84 and on the exterior surface 86 by the rearwardly directed portion 32*a* of the ledge 30*a* of the member 82. Suitable glue or other adhesive applied to the tabs 84 secure the member 82 in the proper position to define the correctly sized subapertures 26*a* for the desired display panels 14. As desired, a small rib 88 is molded into the interior surface 80 of the inwardly directed portion of each first member 46. Engagement of the member 82 with the rib 88 on each first member ensures proper orientation of the member 82 relative to the frame 12.

As noted above in connection with the frame 12, slots 42 defined in the ledge portion 30 are adapted to receive tabs 38 extending from the cover panel 36. Similar slots 42 are also defined in the ledge portions 30*a* of the partition member 82 for the same purpose.

As shown in FIGS. 1 and 2, the aperture 26 may be subdivided more than once, i.e., with one or more vertical partition members 82 and one or more horizontal partition members 82. Such multiple subdivision of the aperture 26 is accomplished in the same manner as the single subdivision described above and in a progressive manner. That is, the aperture 26 is first subdivided in one direction, either vertically or horizontally, with a first partition member 82'. Thereafter, the front wall 20*a* and ledges 30*a* of the first partition member 82' are treated exactly as the front wall 20 and ledge 30 of the frame 12 for purposes of adding a second partition member 82'' perpendicular to the first partition member 82'.

Upon the completion of the frame 12, with any desired subdivision for multiple display panels 14, the frame 12 is secured, as with screws, to a rear panel 90 which carries the desired lighting equipment 16 and/or a clock mechanism (not shown).

The panel 90 comprises sheet metal which is bent to define a plurality of wells 92 adapted to receive fluorescent lights extending between side walls 22*b* and 22*d*. The wells 92 are painted with a reflective white paint. A flange 94 having a width of about three-eighths of an inch extends around the periphery of the panel 90. A set of apertures 96 are defined in the flange 94 at spaced apart locations. The apertures 96 are adapted to receive the shank of a screw 98 and prevent the head of the screw 98 from passing therethrough. A complimenting set of bosses 100 are molded into the connector members 48. Each boss 100 is adapted to threadably receive the screw 98. The bosses 100 are located approximately two-and-one-half inches from the front wall 20 and about one-half inch from the rear edge 102 of the side wall 22. Thus, there is a ratio of about five to one in the distances between the point of attachment of the panel 90 and the front wall and the rear edge 102 of the side wall 22. The combination of the sloped translucent side walls 22 and the spaced relation of the bosses 100 from the front wall 20 and the edge 102 provides a gradual diminution in light intensity from the front wall 20 toward the rear edge 102.

The desired display panels 14 are inserted into the apertures 26*a* to rest upon the ledges 30 and 30*a*, and cover panels 36 are applied over the display panels 14 and secured in position by insertion of the tabs 38 into the slots 42. As desired, some display panels 14 are provided with tabs 38, thus obviating the need for a cover panel 36 for securing purposes.

Frames constructed in accordance with the present invention are extremely economical. The individual members are simple to mold, thus limiting the number of scrapped pieces. Moreover, when a piece must be scrapped, it is only a small portion of a frame rather than an entire frame. Also, the number of molds which must be maintained is reduced substantially, as is the amount of inventory which must be carried, because the same parts are used in several differently sized frames. Furthermore, the amount of plastic material contained in multiple frames is reduced because the partition members include no side walls, only a front wall and ledges. The signs have improved aesthetic appeal due to the gradually diminishing light intensity from the front wall rearwardly. Harsh transitions between the front of the sign and the sides are avoided.

While a preferred embodiment has been shown and described, it will be understood that there is no intention to limit the invention by such disclosure, but rather, it is intended to cover all modifications and alternate constructions falling within the spirit and scope of the invention as defined in the appended claims.

What is claimed:

1. A sign comprising (a) a frame having a rectangular front wall and side walls peripherally joined to the front wall, the side walls extending rearwardly from the front wall to define a rearwardly opening cavity, (b) means defining an aperture in said front wall including an interior peripheral edge, (c) ledge means joined to said front wall around said interior peripheral edge and extending rearwardly and inwardly from said interior peripheral edge, and (d) display panel means having a shape congruent with said aperture defined in said front wall and sized for reception within said aperture and for support by said ledge means, (e) said frame comprising a pair of side members, each of said side members including an elongated central section, a first end section extending perpendicularly from one end of said central section and a second end section extending perpendicularly from the other end of said central section, said first and second end sections of each said side member being parallel to one another, and means for linearly attaching each first end section of each of said pair of side members to the second end section of the other said pair of side members comprising tab means extending longitudinally from at least one of said end sections of one of said pair of side members for frictional engagement with an end section of the other of said side members.

2. A sign as defined in claim 1 and including a first elongated partition member extending between said pair of side members to divide said aperture into a plurality of subapertures and including means for attaching said first partition member to said frame.

3. A sign as defined in claim 1 wherein said linear attaching means comprise a pair of elongated connector members and said connector members include longitudinally extending tab means, each of said connector members being colinearly aligned with said first end section of one of said pair of side members and said second end section of the other of said pair of side members.

4. A sign as defined in claim 2 wherein ledge means are provided along the length of said first partition member.

5. A sign as defined in claim 1 and further comprising means for mounting light means behind said display panel means, and wherein said frame comprises a translucent material, said mounting means being secured to said side walls in spaced relation to said front wall, and said side walls slope rearwardly and outwardly from said front wall, whereby light is transmitted through said side walls in a gradually diminishing manner.

* * * * *